US011585634B2

(12) United States Patent
Wessels et al.

(10) Patent No.: US 11,585,634 B2
(45) Date of Patent: Feb. 21, 2023

(54) DEVICES FOR CARRYING FIREARMS AND RELATED METHODS

(71) Applicants: Spencer Wessels, Montclair, CA (US); Jack Lin, Ontario, CA (US); Gaelyn Chase Hardin, Port Neches, TX (US)

(72) Inventors: Spencer Wessels, Montclair, CA (US); Jack Lin, Ontario, CA (US); Gaelyn Chase Hardin, Port Neches, TX (US)

(73) Assignee: Evike.com Inc., Alhambra, CA (US)

( * ) Notice: Subject to any disclaimer, the term of this patent is extended or adjusted under 35 U.S.C. 154(b) by 0 days.

(21) Appl. No.: 16/826,061

(22) Filed: Mar. 20, 2020

(65) Prior Publication Data

US 2021/0285740 A1 Sep. 16, 2021

Related U.S. Application Data

(60) Provisional application No. 62/794,831, filed on Jan. 21, 2019.

(51) Int. Cl.
*F41C 33/00* (2006.01)

(52) U.S. Cl.
CPC ..... *F41C 33/007* (2013.01)

(58) Field of Classification Search
CPC .... F41C 33/0245; F41C 33/00; F41C 33/002; F41C 33/006; F41C 33/007; F41C 33/008; F41C 33/02; F41C 33/0236
USPC ..... 224/243, 913, 912, 911, 182; 42/85, 99; 2/94
See application file for complete search history.

(56) References Cited

U.S. PATENT DOCUMENTS 2,320,450 A * 6/1943 Valenzuela ..... F41C 33/02 24/3.12
2,758,762 A 8/1956 Medley
2,884,172 A 4/1959 Kubo
2,915,233 A 12/1959 Moomaw
3,353,728 A * 11/1967 Freed ..... F41C 33/0263 224/244
3,642,184 A * 2/1972 Hendricks ..... F41C 33/0245 224/912
4,044,930 A * 8/1977 Petroski ..... F41C 33/0245 224/912
4,056,218 A * 11/1977 Barna ..... F41C 33/008 24/3.9
4,346,827 A 8/1982 Bianchi
4,571,872 A 2/1986 Johnson
4,665,641 A 5/1987 Llames
4,768,689 A 9/1988 Davis
4,974,764 A 12/1990 Cantwell
5,044,106 A * 9/1991 Slocum ..... F41A 17/44 42/70.11
5,611,471 A * 3/1997 French ..... F41C 33/008 224/244
5,630,535 A * 5/1997 Valenti ..... F41C 33/02 224/667
5,669,170 A 9/1997 Norris
5,724,707 A 5/1998 Kirk
5,749,507 A * 5/1998 Wood ..... F41C 33/048 224/678
5,810,219 A 9/1998 Rosenfield
5,927,574 A 7/1999 Ruesink
5,991,925 A 11/1999 Wu
(Continued)

*Primary Examiner* — John Cooper

(57) ABSTRACT

The present invention relates to devices for carrying firearms, including rifles, and methods for making and using devices of the present invention.

17 Claims, 14 Drawing Sheets

(56) References Cited

U.S. PATENT DOCUMENTS 6,152,338 A 11/2000 Smith
6,155,468 A * 12/2000 Kinnich ..... F41C 33/008 224/269
6,247,623 B1 * 6/2001 Walters ..... F41C 33/0236 224/677
6,325,258 B1 12/2001 Verdugo
6,536,153 B2 5/2003 Lindsey
6,598,330 B2 7/2003 Garrett
6,726,072 B2 * 4/2004 Rugh ..... F41C 33/008 42/106
7,082,709 B2 8/2006 Lindsey
7,270,254 B2 9/2007 Kakouras
7,562,484 B2 7/2009 Kim
7,814,697 B2 10/2010 Esch
8,166,694 B2 5/2012 Swan
8,201,271 B2 6/2012 Dennis
8,453,899 B1 6/2013 Calkin
8,943,730 B2 * 2/2015 Ascano ..... F41C 33/007 42/94
9,086,254 B1 * 7/2015 Plappert ..... F41C 33/041
9,144,255 B1 9/2015 Perciballi
9,173,436 B2 11/2015 Crye
9,261,328 B2 * 2/2016 Sitz ..... F41C 33/0245
D757,198 S * 5/2016 McDole ..... D22/108
9,470,475 B1 * 10/2016 Morris ..... F41C 33/048
9,500,441 B2 11/2016 Kirby, Jr.
9,521,897 B2 12/2016 Thompson
9,677,847 B2 * 6/2017 Finsand ..... F41C 33/008
D794,324 S 8/2017 Roccisano
9,879,943 B2 * 1/2018 Ray ..... F41C 33/003
9,903,685 B2 2/2018 Finsand
D812,899 S * 3/2018 Schuster ..... D3/221
9,982,966 B2 * 5/2018 Porat ..... F41G 11/003
D821,189 S 6/2018 Ray
10,010,160 B1 7/2018 Ostrowski
10,159,328 B1 12/2018 Hilliard
10,443,974 B2 10/2019 Finsand
10,551,151 B2 2/2020 LeMarbe
11,002,510 B2 * 5/2021 Sitz ..... F41C 33/041
11,092,403 B2 * 8/2021 Ray ..... F41C 33/007
11,193,725 B2 * 12/2021 Lee ..... F41A 9/71
2003/0029897 A1 2/2003 Beletsky
2003/0101508 A1 6/2003 Marshall
2005/0034347 A1 * 2/2005 Verdugo ..... F41C 23/02 42/85
2006/0208016 A1 9/2006 Esch
2009/0288325 A1 * 11/2009 Esch ..... F41C 23/02 42/85
2010/0044405 A1 * 2/2010 Albert ..... F41C 33/041 224/678
2011/0191933 A1 8/2011 Gregory
2012/0030986 A1 * 2/2012 Swan ..... F41C 33/007 42/90
2012/0266352 A1 * 10/2012 Busch ..... F41C 33/007 403/375
2012/0286005 A1 * 11/2012 Farnlacher ..... F41C 33/0245 224/244
2013/0276343 A1 * 10/2013 Peters ..... F41C 33/006 29/469
2013/0327798 A1 * 12/2013 Lee ..... F41C 33/008 224/183
2013/0327799 A1 * 12/2013 Sitz ..... F41A 23/18 224/243
2014/0075650 A1 3/2014 Garrison
2014/0367427 A1 * 12/2014 Bjelde ..... F41C 33/002 224/257
2015/0377585 A1 * 12/2015 Fowler ..... F41C 33/0236 224/271
2016/0003578 A1 * 1/2016 Vertreese ..... F41C 33/0236 224/192
2016/0040957 A1 * 2/2016 Finsand ..... F41C 33/008 224/269
2016/0265876 A1 * 9/2016 Young ..... F41C 33/048
2016/0341519 A1 * 11/2016 Gaiser ..... F41C 33/0245
2016/0377371 A1 12/2016 Anthony
2017/0160051 A1 * 6/2017 Munz ..... F41C 33/0209
2018/0149447 A1 * 5/2018 Waters ..... H01F 7/0252
2018/0187990 A1 * 7/2018 Ray ..... F41C 23/12
2019/0212096 A1 * 7/2019 Lance ..... F41C 33/0254
2019/0339039 A1 11/2019 Yeates
2020/0096289 A1 * 3/2020 Fischer ..... F41C 33/007

* cited by examiner

DEVICES FOR CARRYING FIREARMS AND RELATED METHODS

This application claims the benefit of U.S. Provisional Application No. 62/794,831, filed Jan. 21, 2019, which is incorporated herein by reference in its entirety.

1.0 FIELD OF THE INVENTION

The present invention relates to devices for carrying firearms, including rifles, air guns, airsoft guns, and methods for making and using devices of the present invention.

2.0 BACKGROUND

Firearms are used in many situations, including hunting, law enforcement and combat. Those using firearms are at times in need of freeing their hands while having the firearm close by and ready and available, preferably so the firearm can be reached by the user without undue delay. Devices that allow having more than one firearm close by and ready for use would also be useful. Preferably, a device that disposes a firearm in a close and ready to use position outside the user's hands would not excessively interfere with actions and operations of the user of the firearm. Devices to dispose of a firearm in a ready to use position should also be simple, easy to manufacture, and reliable in their use.

There remains a need for better devices for disposing of firearms in a ready to use position, while outside the user's hands. The present invention describes such devices and methods for making and using such devices.

3.0 SUMMARY OF THE INVENTION

The present invention relates to devices for carrying one or more firearms, including a rifle, an automatic rifle, a semi-automatic rifle, a sniper rifle, an assault rifle, an uzi, a bazooka, a machine gun, or any other type or kind of firearm.

In certain embodiments, a device of the current invention comprises a coupler. A coupler of the current invention, in certain embodiments, is capable of catching onto an article that a user of the firearm is wearing, for example, a vest, a MOLLE vest or system (MOLLE refers to MOdular Lightweight Load-carrying Equipment), a harness, or some other article.

In certain embodiments, a device of the current invention comprises an attachment feature configured to attach the device to a firearm. An attachment feature configured to attach a device of the invention to a firearm, in certain embodiments, comprises a holding ring, a clamp, a wire, a string, a screw, a bolt, a clinch, a rope, a cord, a thread, a web, or any other structure useful for attaching the device to a firearm. A device of the current invention, in certain embodiments, may be attached to a firearm in a reversible or irreversible manner, or a permanent or a temporary manner. A device of the current invention, in certain embodiments, may be attached to a firearm at any one or more of the features or structures or accessories of the firearm.

In certain embodiments, the invention includes methods for making a device of the current invention and methods for using a device of the current invention.

4.0 BRIEF DESCRIPTION OF THE DRAWINGS

The present invention is better understood with reference to the accompanying figures. The appended figures are included solely for purposes of illustrating a few of the many embodiments of the current invention. It is understood that multiple embodiments of the current invention are not shown in the appended figures but are within the scope of the current invention.

FIG. 1: A device, and its use, according to certain embodiments of the current invention are shown. The device is in solid lines, including a rifle attachment 1 of the device and a coupler 2 of the device. The device is attached to a rifle 3 and holding onto a MOLLE vest 4. The rifle 3 and the MOLLE vest 4 are shown in broken lines to better point out the device.

Figure 4:
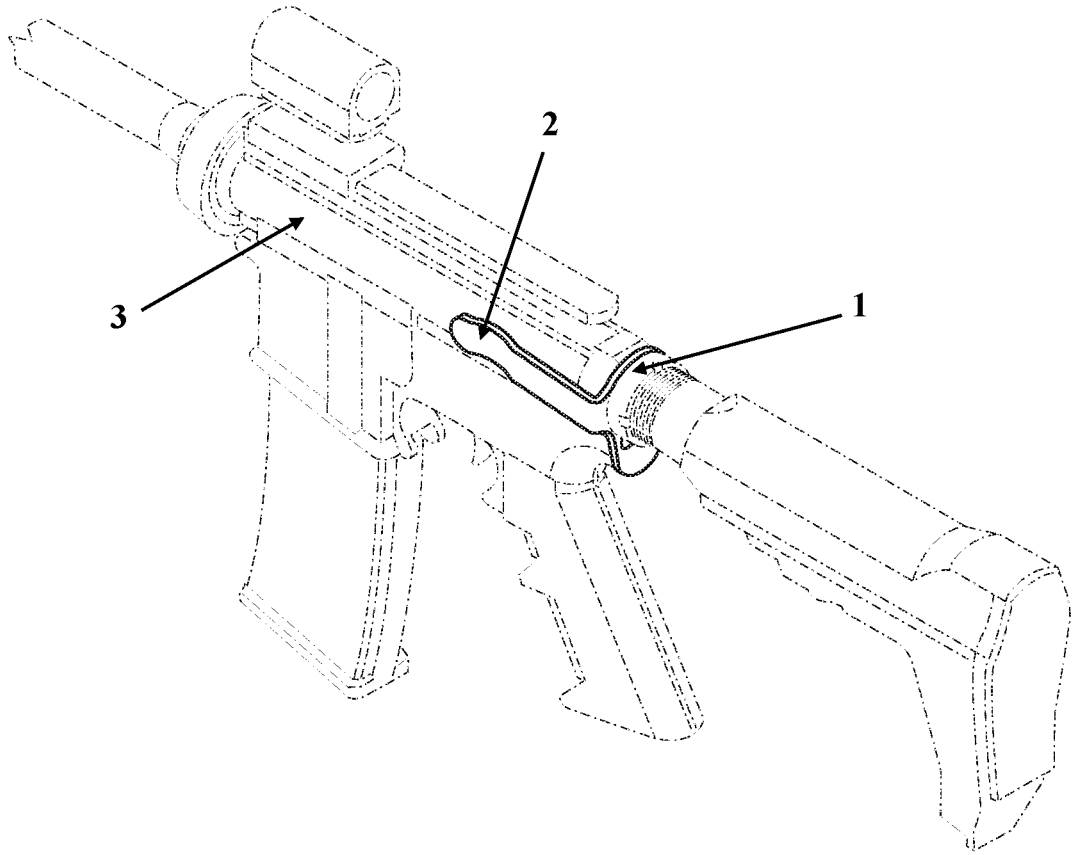

FIG. 4: A device, and its use, according to certain embodiments of the current invention are shown. The device is in solid lines, including a rifle attachment 1 of the device and a coupler 2 of the device. The device is attached to a rifle 3, shown in broken lines to better point out the device.

Figure 5:
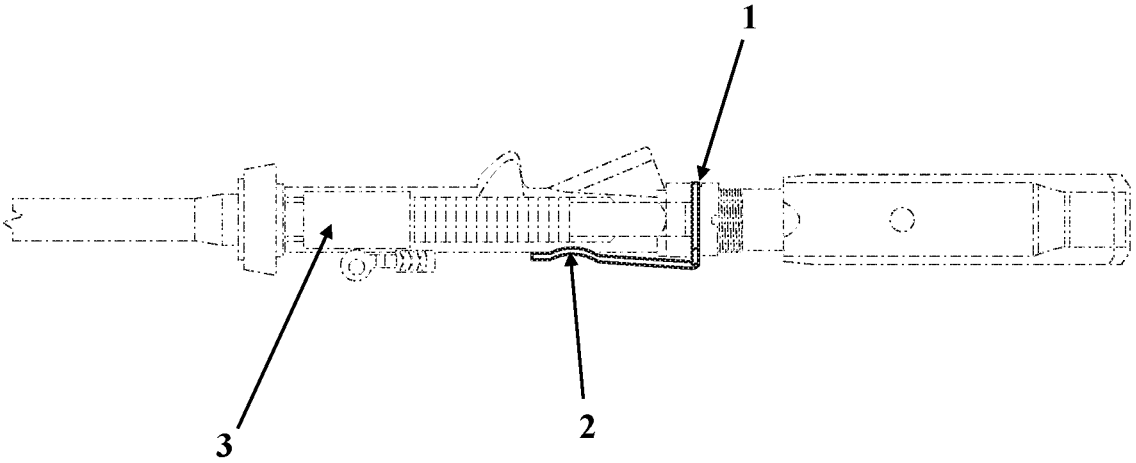

FIG. 5 shows a top view of the embodiment shown in FIG. 4.

Figure 6:
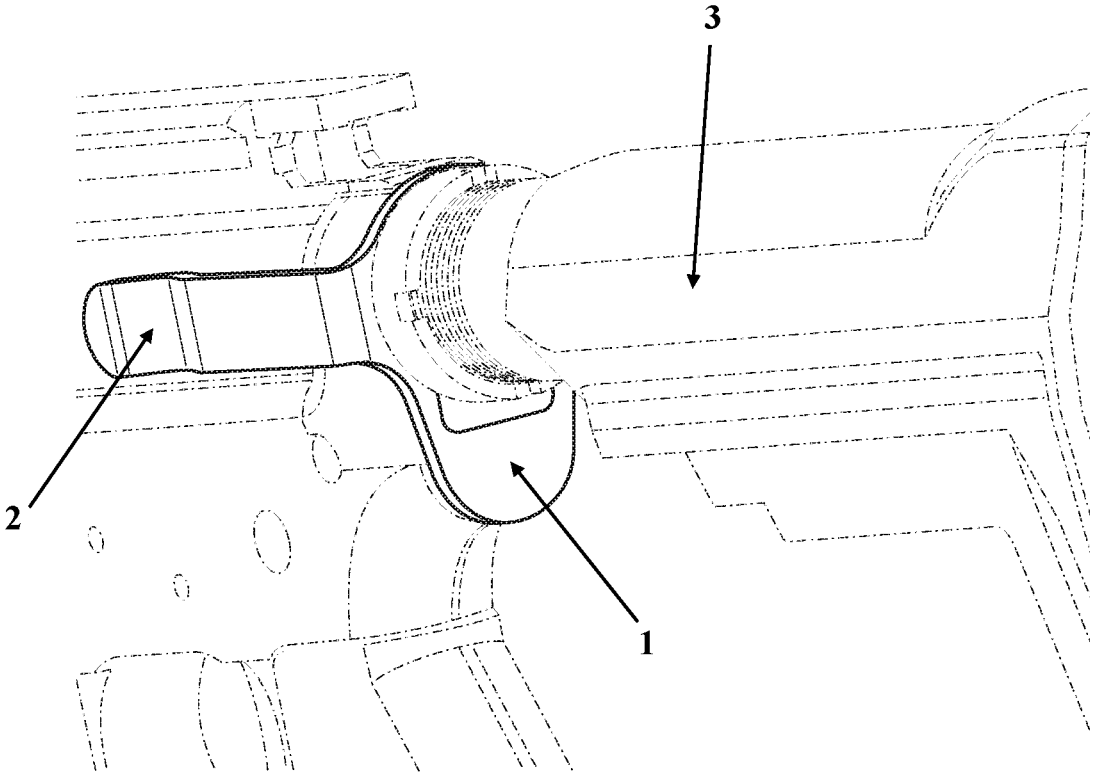

FIG. 6 shows an enlarged side view of the embodiment shown in FIG. 4.

Figure 7:
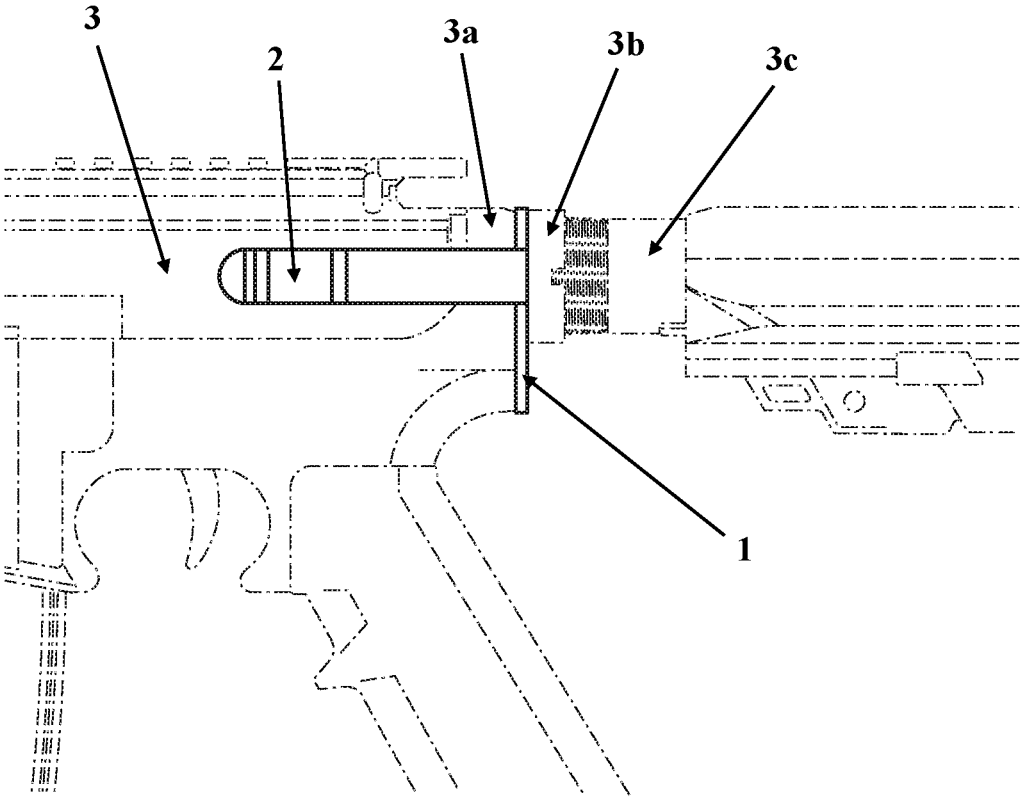

FIG. 7 shows another enlarged side view of the embodiment shown in FIG. 4. FIG. 7 also exemplifies the installation of the device on a rifle 3 according to certain embodiments between the receiver 3*a* and the receiver extension (also called buffer tube) 3*c* and tightened in place by a castle nut 3*b*.

Figure 8:
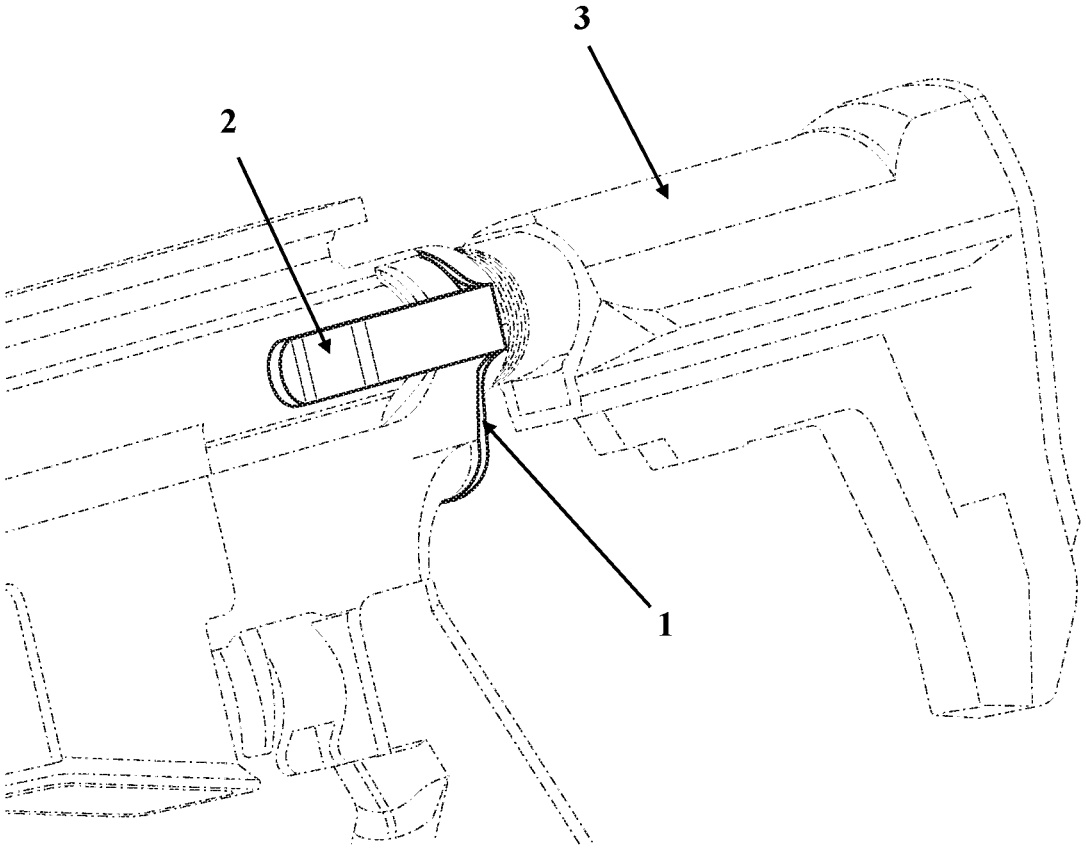

FIG. 8 shows another enlarged side view of the embodiment shown in FIG. 4.

Figure 9:
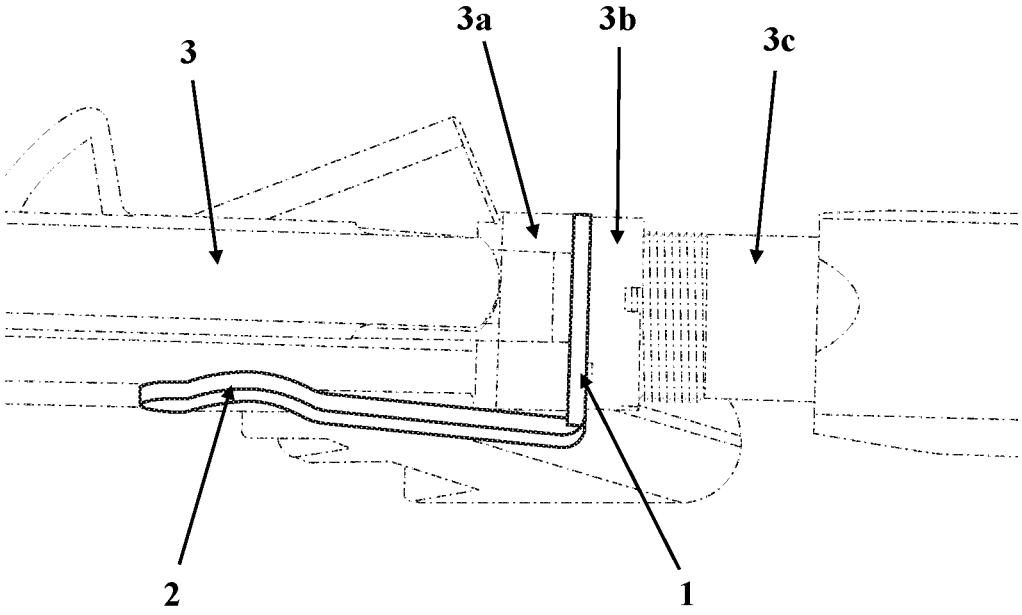

FIG. 9 shows an enlarged top view of the embodiment shown in FIG. 4. FIG. 9 also exemplifies the installation of the device on a rifle 3 according to certain embodiments between the receiver 3*a* and the receiver extension (also called buffer tube) 3*c* and tightened in place by a castle nut 3*b*.

Figure 10:
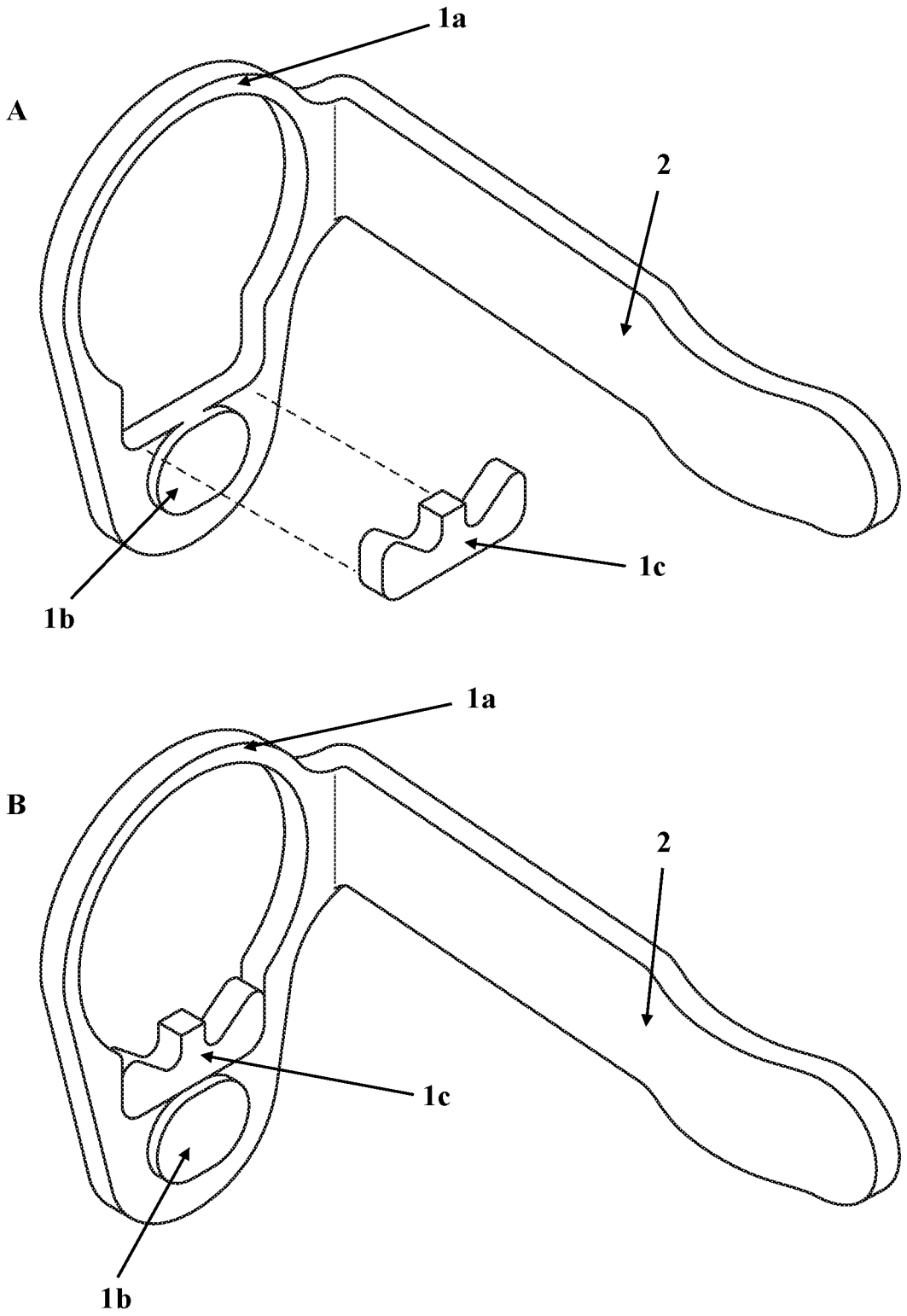

FIG. 10 shows a device according to certain embodiments of the invention. FIG. 10A shows a rifle attachment 1*a-c* and a coupler 2 of the device, including a receiver end plate 1*a*, a protrusion referred to as a receiver index tab 1*b*, and an insert referred to as a receiver extension anti-rotation insert 1*c* that was removed. FIG. 10B shows the insert 1*c* inserted.

Figure 11:
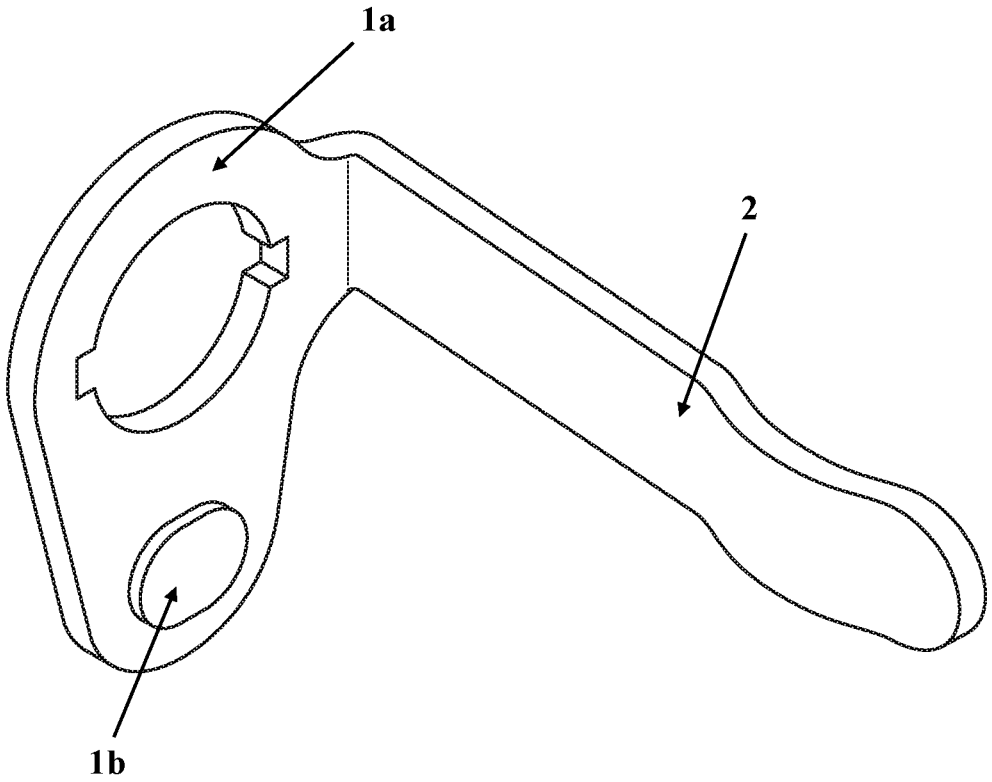

FIG. 11 shows a device according to certain embodiments of the invention with a rifle attachment 1*a-b* and a coupler 2 of the device, including a receiver end plate 1*a* and a protrusion referred to as a receiver index tab 1*b*.

Figure 12:
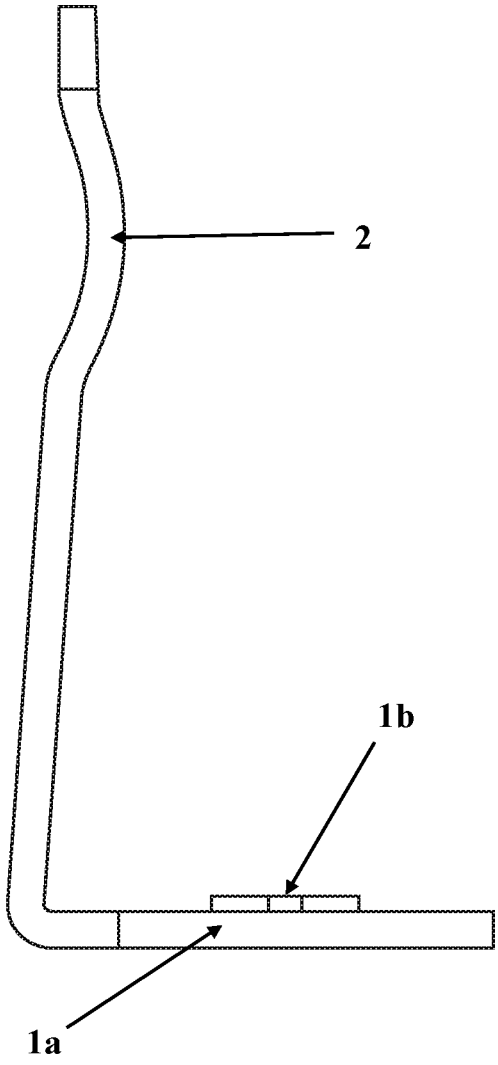

FIG. 12 shows a top view of the embodiment shown in FIG. 11.

Figure 13:
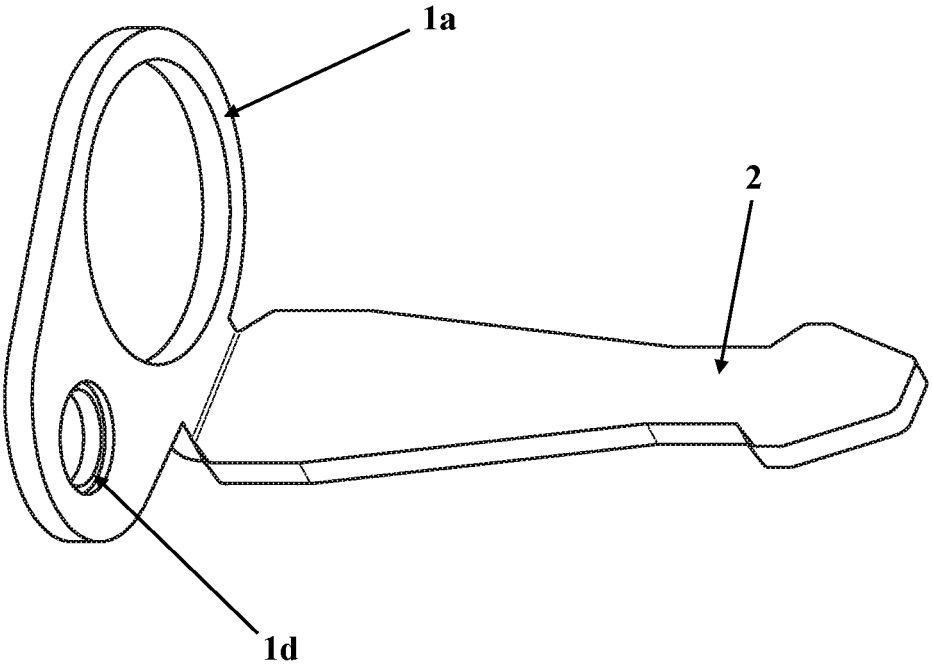

FIG. 13 shows a device according to certain embodiments of the invention with a rifle attachment 1*a*, 1*d* and a coupler 2 of the device, including a receiver end plate 1*a* and a cutout referred to as a quick detach sling swivel mount 1*d*.

Figure 14:
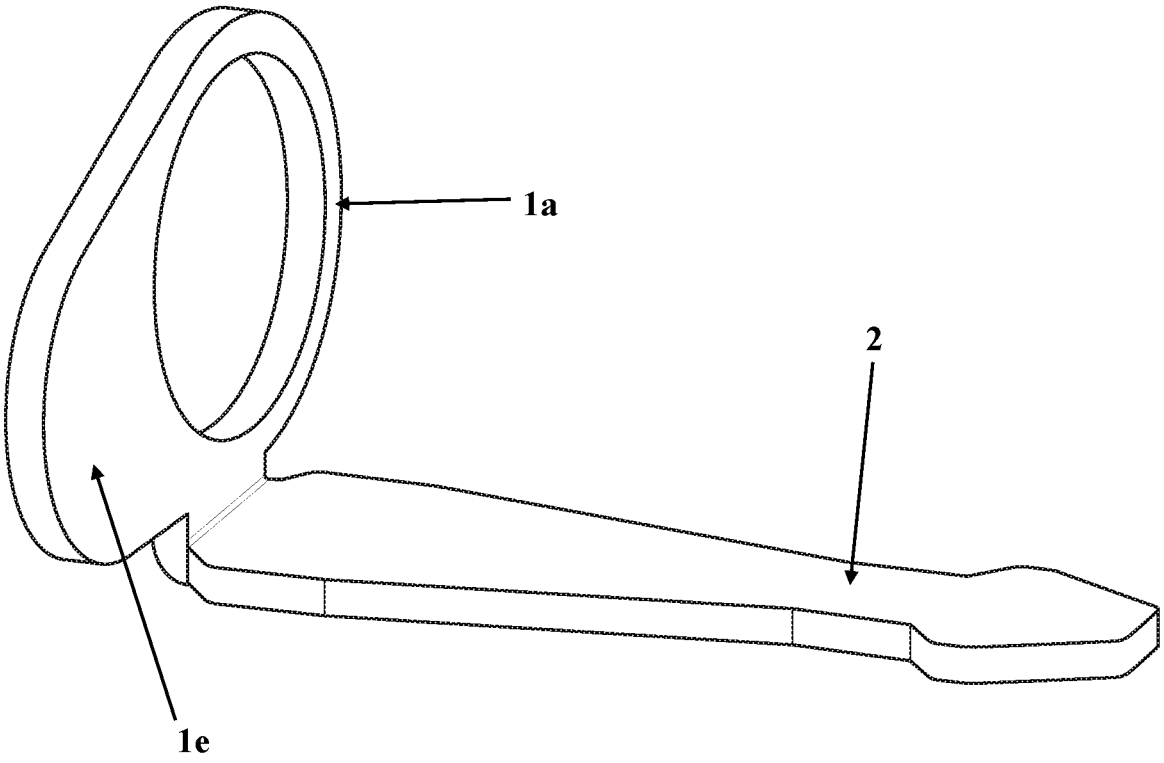

FIG. 14 shows a device according to certain embodiments of the invention with a rifle attachment 1*a*, 1*e* and a coupler 2 of the device, including a receiver end plate 1*a* and a featureless end plate 1*e*.

5.0 DETAILED DESCRIPTION OF THE INVENTION

The present invention relates to devices for carrying a firearm, preferably in a hand-free configuration. The present invention further relates to methods for carrying a firearm using a device of the current invention. The present invention also relates to methods of making a device of the current invention.

5.1 Devices for Carrying a Firearm

In certain embodiments, a device of the current invention comprises a coupler. A coupler of the current invention, in certain embodiments, is capable of being attached to a firearm and is capable of catching onto an article that a user of the firearm is wearing, for example, a belt, a vest, a harness, or some other article.

In certain embodiments, a device of the invention comprises an attachment feature that is configured for attachment of the device to a firearm. In certain embodiments, a coupler of a device of the invention is configured for attachment of the device to a firearm. In certain embodiments, a coupler and an attachment feature of a device of the current invention are in a single part, or two parts, or three parts, or four parts, or five parts, or 5-10 parts, or 1-5 parts, or 2-5 parts.

Figure 1:
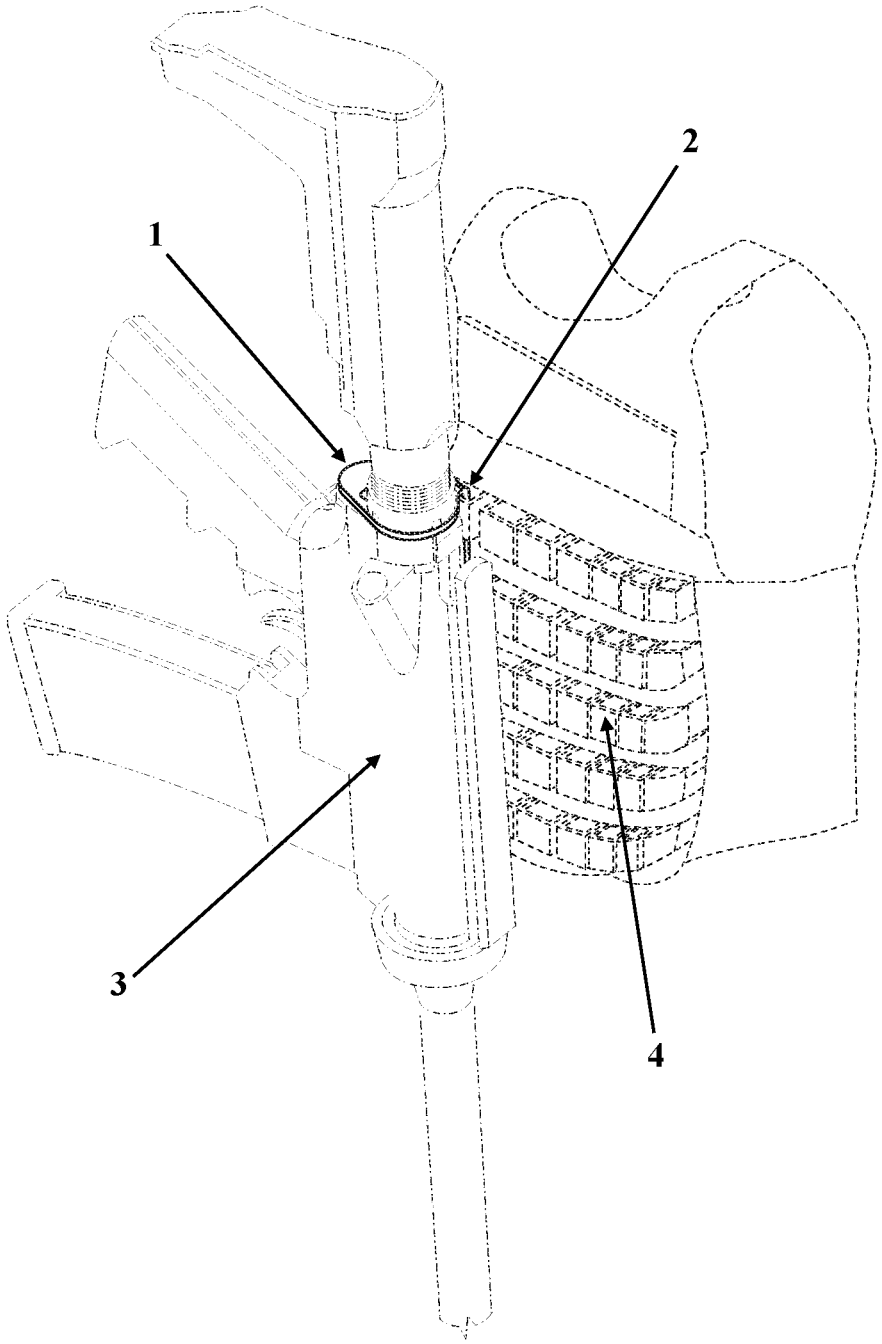
Figure 2:
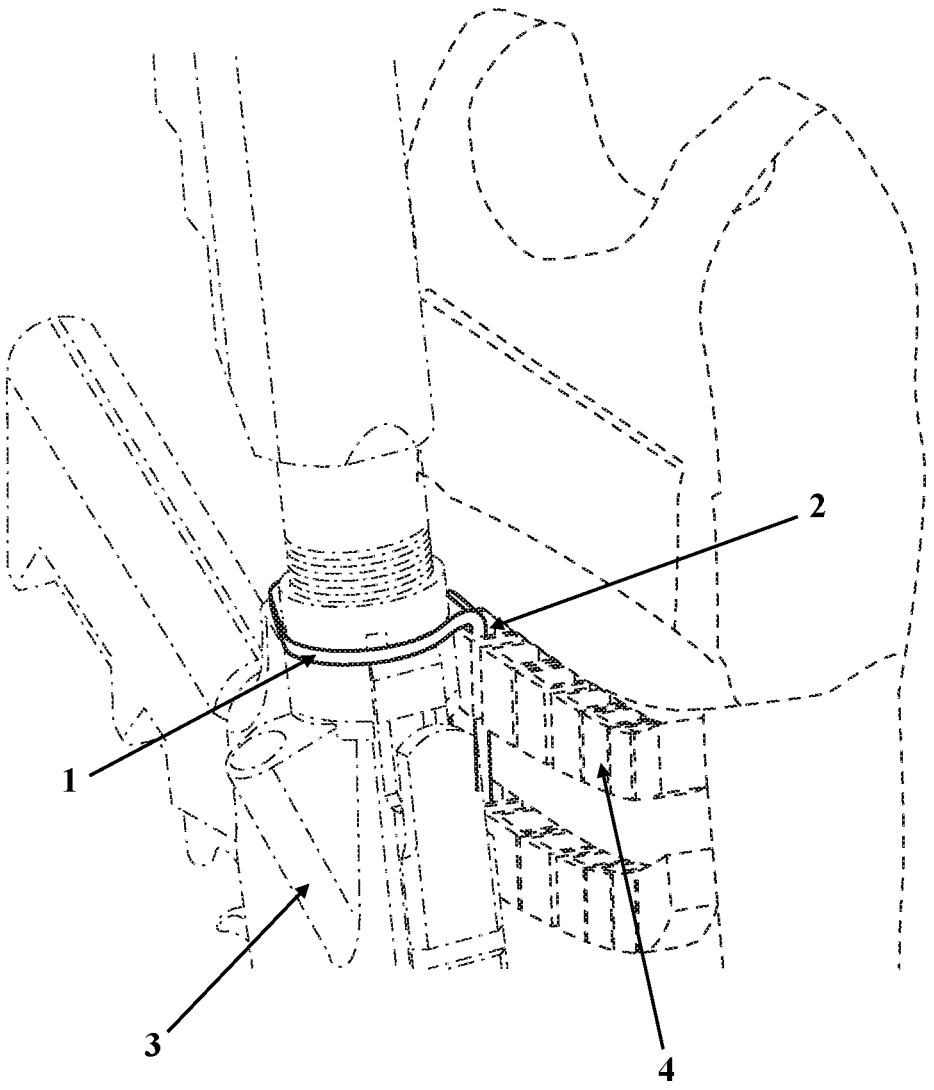
FIG. 2 shows an enlarged section of the embodiment shown in FIG. 1.
Figure 3:
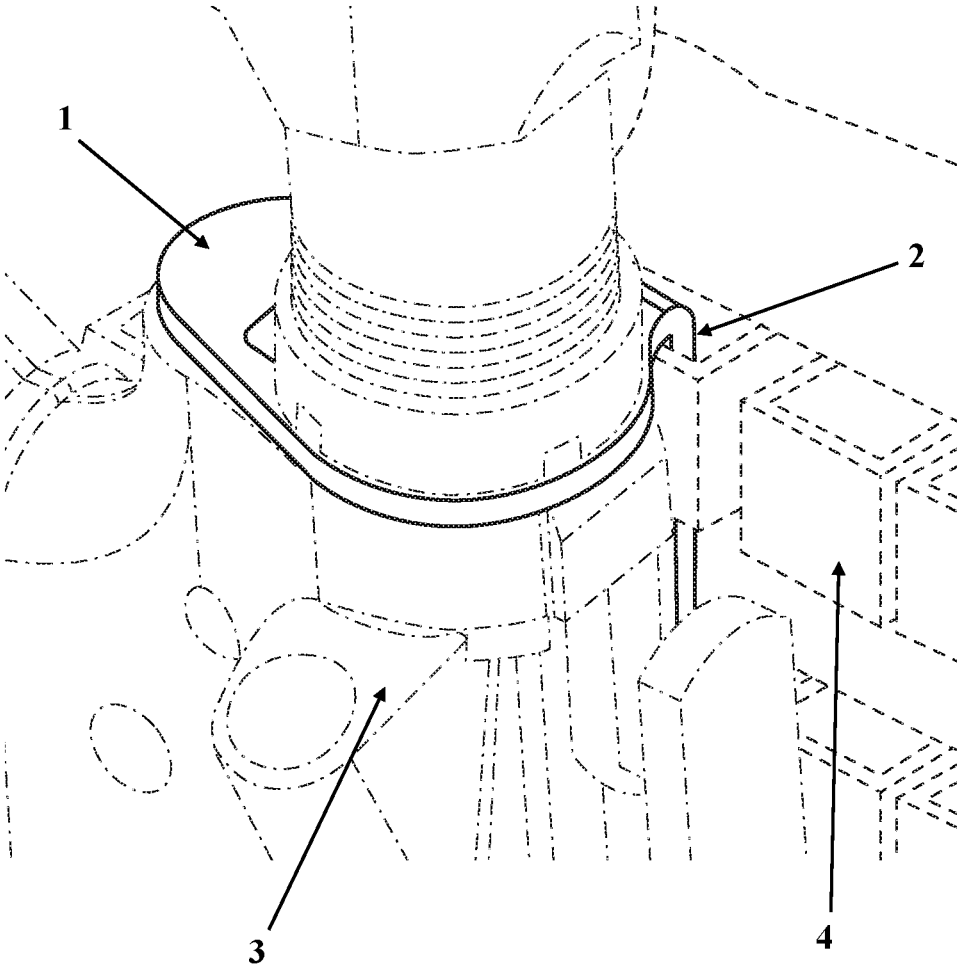
FIG. 3 shows an enlarged section of the embodiment shown in FIG. 1.

The appended figures show non-exhaustive and non-limiting examples of a few devices according to certain embodiments of the current invention. FIG. 1 shows a device according to certain embodiments of the current invention attached to a rifle and holding onto a MOLLE vest. Exemplified are a rifle attachment 1 of the device and a coupler 2 of the device attached to a rifle 3 and holding onto a MOLLE vest 4. The rifle 3 and the MOLLE vest 4 are shown in broken lines to better point out the device. The rifle 3 exemplified in FIG. 1 is an AR-15 rifle. FIGS. 2 and 3 show enlarged sections of the embodiment illustrated in FIG. 1. The device shown in FIGS. 1-3 is attached to the rifle by removing the stock of the rifle, by inserting the rifle into the rifle attachment 1 of the device, and by reattaching the stock. A device of the current invention as exemplified in FIGS. 1-3 can be used on any one of an AR15 rifle, an AR15 style rifle, an AR15 style airsoft rifle, and a firearm that can accept an AR15 style receiver end plate.

FIG. 4 shows a device according to certain embodiments of the current invention attached to a rifle. Exemplified are a rifle attachment 1 of the device and a coupler 2 of the device. The device is attached to a rifle 3, shown in broken lines to better point out the device. The rifle 3 exemplified in FIG. 4 is an AR-15 rifle. FIGS. 5-9 show views from different angles and enlarged views of the embodiment illustrated FIG. 4. The device shown in FIGS. 4-9 is attached to the rifle by removing the stock of the rifle, by inserting the rifle into the rifle attachment 1 of the device, and by reattaching the stock. A device of the current invention as exemplified in FIGS. 4-9 can be used on any one of an AR15 rifle, an AR15 style rifle, an AR15 style airsoft rifle, and a firearm that can accept an AR15 style receiver end plate.

FIG. 10 shows a device according to certain embodiments of the current invention. Exemplified are in FIGS. 10A and 10B a rifle attachment 1*a-c* and a coupler 2 of the device. The rifle attachment shown in FIG. 10A comprises a receiver end plate 1*a*, a receiver index tab 1*b*, and a receiver extension anti-rotation insert 1*c* that was removed from the attachment. FIG. 10B shows the embodiment in FIG. 10B with the insert 1*c* inserted. A receiver index tab 1*b* can be inserted into a niche on the receiver of a rifle and it inhibits, and preferably prevents, the device from rotating and/or otherwise moving with respect to the receiver. The receiver extension anti-rotation insert 1*c* allows the device to be installed without a need for the device to rotate, which could interfere with the receiver. A device of the current invention as exemplified in FIG. 10 can be used on any one of an AR15 rifle, an AR15 style rifle, an AR15 style airsoft rifle, an AR15 style air gun, and a firearm that can accept an AR15 style receiver end plate.

FIG. 11 shows a device according to certain embodiments of the current invention. Exemplified in FIG. 11 are a rifle attachment 1*a-b* and a coupler 2 of the device. The rifle attachment shown in FIG. 11 comprises a receiver end plate 1*a* and a receiver index tab 1*b*. FIG. 12 shows a top view of the embodiment illustrated FIG. 11. A device of the current invention as exemplified in FIGS. 11 and 12 can be used on any one of any airsoft gun that can accept a Tokyo Marui style M4 receiver end plate.

FIG. 13 shows a device according to certain embodiments of the current invention. Exemplified in FIG. 13 are a rifle attachment 1*a*, 1*d* and a coupler 2 of the device. The rifle attachment shown in FIG. 13 comprises a receiver end plate 1*a* and a quick detach sling swivel mount 1*d*. A quick detach sling swivel mount 1*d* provides a sling attachment loop that preferably allows quick removal of a sling via a push button. A quick detach sling swivel known in the field of firearms can be used with the quick detach sling swivel mount 1*d*. A device of the current invention as exemplified in FIG. 13 can be used on any one of an AR15 rifle, an AR15 style rifle, an AR15 style airsoft rifle, an air gun, and a firearm that can accept an AR15 style receiver end plate.

FIG. 14 shows a device according to certain embodiments of the current invention. Exemplified in FIG. 14 are a rifle attachment 1*a*, 1*e* and a coupler 2 of the device. The rifle attachment shown in FIG. 14 comprises a receiver end plate 1*a* and a featureless end plate 1*e*. A featureless end plate 1*e* can be used on a rifle with a receiver that does not have an index notch that can receive a receiver index tab 1*b*. A featureless end plate 1*e* can be mounted on the rear of the receiver and tightened in place by a castle nut. A device of the current invention as exemplified in FIG. 14 can be used on any one of an AR15 rifle, an AR15 style rifle, an AR15 style airsoft rifle, an AR15 style air gun, and a firearm that can accept an AR15 style receiver end plate.

A device as exemplified in any one of FIGS. 1-14, in certain embodiments, can be attached to a rifle by mounting it on the rear of the receiver of the rifle, between the receiver and the stock of the rifle. The device can be held in place by a receiver extension (also called a buffer tube), and it can be tightened in place by a castle nut. FIGS. 7 and 9 show further detail on the installation of a device according to certain embodiments of the current invention on a rifle. As exemplified in FIGS. 7 and 9, the device can be installed on a rifle 3 according to certain embodiments between the receiver 3*a* and the receiver extension (also called buffer tube) 3*c* and tightened in place by a castle nut 3*b*.

In certain embodiments, a device of the current invention comprises a coupler and an attachment that are configured at an angle of 90 degrees relative to each other, or an angle of less than 90 degrees, as exemplified by the coupler 2 and the receiver end plate 1*a* in FIG. 12, according to certain embodiments. The angle between coupler and attachment may be 80 to 90 degrees, or about 80 to about 90 degrees, or 82 to 88 degrees, or about 82 to about 88 degrees, or 84 to 88 degrees, or about 84 to about 88 degrees, or 85 to 87 degrees, or about 85 to about 87 degrees, or 85.5 to 86 degrees, or about 85.5 to about 86 degrees, or 86 degrees, or about 86 degrees, or 85.78 degrees, or about 85.78 degrees.

In certain embodiments, a device of the current invention further comprises a ring, preferably a small ring, which can be used in certain embodiments as a sling attachment, for example, for weapon retention. A ring of a device of the current invention, in certain embodiments, is attached to any component of the device, and preferably to an attachment feature of the device. A ring of a device of the current invention, in certain embodiments, is attached to the device so that any interference with a use of the device for carrying a firearm is minimized and preferably avoided. In certain embodiments, a ring of a device of the current invention is attached to a receiver end plate of the device. In certain embodiments, a ring of a device of the current invention has an inner diameter of 0.5 to 5 centimeters (cm), or about 0.5 to about 5 cm, or 1 to 3 cm, or about 1 to about 3 cm, or 2 to 3 cm, or about 2 to about 3 cm.

In certain embodiments, a device of the current invention can be made of any material of sufficient strength and durability, or of a combination of materials, for example, two, three, four, five, or more materials. Non-exhaustive examples of materials for making a device of the current invention are a metal, a light metal, a steel, iron, aluminum, an amalgam, a plastic, a hard plastic, or any other known material used in the field of firearms and/or accessories for firearms.

5.1.1 Couplers of Devices of the Current Invention

In certain embodiments, a coupler of the current invention comprises a plate, a strip, or an article with a shape of a rectangle, an oval, or an oblong shape, or a combination of these shapes. In certain embodiments, a coupler of the current invention has a shape with a long axis and a shorter perpendicular axis, for example, the long axis may be 2 to 10 times the shorter axis, or about 2 to about 10 times, or 3 to 8 times, or about 3 to about 8 times, or 4 to 6 times, or about 4 to about 6 times. A coupler of the current invention, in certain embodiments, is 2 to 15 centimeters (cm) long, or about 2 to about 15 cm long, or 3 to 10 cm long, or about 3 to about 10 cm long, or 4 to 8 cm long, or about 4 to about 8 cm long, or 2 to 10 cm long, or about 2 to about 10 cm long, or 3 to 8 cm long, or about 3 to about 8 cm long. In certain embodiments, a coupler of the current invention has a thickness that provides sufficient strength to hold the weight of the firearm, for example, 1 to 6 millimeter (mm), or about 1 to about 6 mm, or 2 to 5 mm, or about 2 to about 5 mm, or 3 to 4 mm, or about 3 to about 4 mm.

In certain embodiments, a coupler of the current invention can be attached to a firearm on one end and it can hook onto an article that a user of the firearm is wearing with its other end.

5.1.2 Attachment Features of a Device of the Invention

In certain embodiments, a device of the current invention can be attached to a firearm. A device may be attached to a firearm, in certain embodiments, in a reversible or irreversible manner. In certain embodiments, a device of the current invention comprises an attachment feature that can be attached to a firearm, and a coupler that can be reversibly or irreversibly attached, connected, interlocked, linked, coupled and/or joined to the attachment feature of the device.

A device of the current invention, in certain embodiments, can be reversibly or irreversibly attached, connected, interlocked, linked, coupled and/or joined to any part of a firearm, for example, a butt, a butt plate, a stock, a comb, a receiver, a grip, a sight, a rear sight, a front sight, a barrel extension, a handguard, a barrel, a barrel extension, a mount, or more than one of those parts, or between any two or more of those parts. A device of the current invention, in certain embodiments, can be attached to an accessory or article that is not a component of the firearm but that can be or is reversibly or irreversibly attached, connected, interlocked, linked, coupled and/or joined to the firearm, for example, a mount or any other kind of accessory or article.

In certain embodiments, an attachment feature of a device of the current invention may comprise any one or more of a holding ring, a clamp, a wire, a string, a screw, a bolt, a clinch, a rope, a cord, a thread, a web, or any other structure useful for attaching the device to a firearm.

5.2 Firearms that can be Carried Using a Device of the Invention

The present invention according to certain embodiments relates to devices for carrying one or more firearms, including a rifle, an automatic rifle, a semi-automatic rifle, a sniper rifle, an assault rifle, an uzi, a bazooka, a machine gun, or any other type or kind of firearm.

A device of the current invention, in certain embodiments, can be used on an AR15 rifle, an AR15 style rifle, an AR15 style airsoft rifle, a firearm that can accept an AR15 style receiver end plate, and/or a firearm that can accept a Tokyo Marui style receiver end plate. A device of the current invention, in certain embodiments, can be used on a M4 rifle and/or a M16 rifle. A device of the current invention, in certain embodiments, can be used on an airgun, an airsoft rifle, an airsoft AEG, an airsoft GBBR, and/or an airsoft spring gun.

5.3 Articles that a Device of the Invention can Hold onto

In certain embodiments, a device of the current invention is capable of holding onto an article, for example, an article of clothing a user of a firearm may be wearing by catching a part or segment of the article. An article of clothing that a device is capable of holding onto, in certain embodiments, may be any one or more of a MOLLE vest or system (MOLLE refers to MOdular Lightweight Load-carrying Equipment), a web belt, a belt, a vest, a harness, or some other article.

Non-exhaustive examples of articles that a device may catch onto are further discussed, for example, in U.S. Pat. Nos. 10,551,151; 10,159,328; 10,010,160; 9,521,897; 9,173,436; 9,144,255; 8,453,899; 8,201,271; 5,991,925; 5,724,707; D794,324; and in U.S. Patent Applications Nos. 2019/0339039; 2015/0377585; 2011/0191933; 2003/0101508; 2003/0029897, and in references discussed in any one of these patents and patent applications. All of these patents and patent applications, and references discussed therein, are expressly incorporated herein by reference in their entirety for all purposes.

5.4 Methods for Carrying a Firearm

In certain embodiments, a method for carrying a firearm comprises attaching a device of the current invention to a firearm, and using the coupler of the device for hooking the firearm onto an article, for example, an article that a user of the firearm is wearing.

5.5 Methods for Making a Device of the Invention

A device of the current invention, in certain embodiments, can be made by 3d printing, injection molding, machining, die-cutting, and/or stamping, or any other method known in the art. In certain embodiments, a device of the current invention is made by plastic injection molding, for example, directly from a sample drawing. In certain embodiments, a device of the invention is made by CNC machining from billet steel or aluminum. In certain embodiments, a device of the invention is made by die-cutting from sheet steel, preferably followed by stamping into a final form.

The present invention is not to be limited in scope by the specific embodiments described herein, which are intended as single illustrations of individual aspects of the invention, and functionally equivalent methods and components are within the scope of the invention. Indeed, various modifications of the invention, in addition to those shown and described herein, will become apparent to those skilled in the art from the foregoing description. Such modifications are intended to fall within the scope of the appended claims. All publications, including patent documents and scientific articles, referred to in this application and the bibliography and attachments are incorporated by reference in their entirety for all purposes to the same extent as if each individual publication were individually incorporated by reference. The article "a" as used herein means one or more unless indicated otherwise. All headings are for the convenience of the reader and should not be used to limit the meaning of the text that follows the heading, unless so specified.

What is claimed is:

1. A device for carrying a firearm comprising a coupler and an attachment feature, wherein the coupler comprises a plate, a strip, or an article with a shape of a rectangle, an oval, or an oblong shape, or a combination of these shapes, wherein the coupler is configured to hold onto an article of clothing, wherein the article of clothing comprises one or more of a MOLLE vest or system, a web belt, a belt, a vest, and a harness, wherein the attachment is configured to hold onto a firearm, and wherein the planar faces of the coupler and the attachment are configured at an angle of about 80 to about 90 degrees relative to each other.

2. The device according to claim 1, wherein the coupler and the attachment feature are one part.

3. The device according to claim 1, wherein the coupler and the attachment feature are 1-5 parts.

4. The device according to claim 1, wherein the coupler is about 2 to about 10 cm long.

5. The device according to claim 1, wherein the coupler has a thickness of about 2 to about 5 mm.

6. The device according to claim 1, wherein the attachment feature is configured for attachment to a firearm by inserting a component of the firearm into an opening of the attachment feature.

7. The device according to claim 1, wherein the attachment feature is configured to attach the device to any one or more of a rifle, an automatic rifle, a semi-automatic rifle, an uzi, a bazooka, an air gun, an airsoft gun, and a machine gun.

8. A device for carrying a firearm comprising a coupler and an attachment feature, wherein the coupler comprises a plate, a strip, or an article with a shape of a rectangle, an oval, or an oblong shape, or a combination of these shapes, wherein the coupler is configured to hold onto an article of clothing, wherein the article of clothing comprises one or more of a MOLLE vest or system, a web belt, a belt, a vest, and a harness, and wherein the attachment is configured to hold onto a firearm between a receiver and a buffer tube of the firearm.

9. The device according to claim 8, wherein the coupler and the attachment feature are one part.

10. The device according to claim 8, wherein the coupler has a thickness of about 2 to about 5 mm.

11. The device according to claim 8, wherein the attachment feature is configured for attachment to a firearm by inserting a component of the firearm into an opening of the attachment feature.

12. The device according to claim 8, wherein the attachment feature is configured to attach the device to any one or more of a rifle, an automatic rifle, a semi-automatic rifle, an uzi, a bazooka, an air gun, an airsoft gun, and a machine gun.

13. A device for carrying a firearm comprising a coupler and an attachment feature, wherein the coupler comprises a plate, a strip, or an article with a shape of a rectangle, an oval, or an oblong shape, or a combination of these shapes, wherein the coupler is configured to hold onto an article of clothing, wherein the article of clothing comprises one or more of a MOLLE vest or system, a web belt, a belt, a vest, and a harness, and wherein the attachment is configured to hold onto a buffer tube of a firearm.

14. The device according to claim 13, wherein the coupler and the attachment feature are one part.

15. The device according to claim 13, wherein the coupler has a thickness of about 2 to about 5 mm.

16. The device according to claim 13, wherein the attachment feature is configured for attachment to a firearm by inserting a component of the firearm into an opening of the attachment feature.

17. The device according to claim 13, wherein the attachment feature is configured to attach the device to any one or more of a rifle, an automatic rifle, a semi-automatic rifle, an uzi, a bazooka, an air gun, an airsoft gun, and a machine gun.

* * * * *